United States Patent [19]

Schmidt

[11] 3,989,273

[45] Nov. 2, 1976

[54] HEEL MOUNTING DEVICE FOR SKI BINDING

[75] Inventor: Hans Schmidt, Neu-Germering, Germany

[73] Assignee: Hannes Marker, Garmisch-Partenkirchen, Germany

[22] Filed: June 23, 1975

[21] Appl. No.: 589,005

[30] Foreign Application Priority Data

July 12, 1974 Germany ..... 2433714

[52] U.S. Cl. ..... 280/631

[51] Int. Cl.[2] ..... A63C 9/08

[58] Field of Search ..... 280/11.35 T, 11.35 C, 280/11.35 H, 631

[56] References Cited

UNITED STATES PATENTS

| | | | |
|---|---|---|---|
| 3,675,937 | 7/1972 | Laszlo | 280/11.35 T |
| 3,695,625 | 10/1972 | Salomon | 280/11.35 T |
| 3,754,770 | 8/1973 | Suhner | 280/11.35 T |
| 3,768,822 | 10/1973 | Kanno | 280/11.35 T |

*Primary Examiner*—Robert R. Song
*Attorney, Agent, or Firm*—Fleit & Jacobson

[57] ABSTRACT

In a mounting device for the heel of a ski boot, a sole depressor is lockable in a heel-engaging pivoted position irrespective of the sole thickness or any snow packed beneath the sole. A locking arm carried by the sole depressor or a frame member passes through a hole in a clamping plate pivoted to the frame member or depressor, respectively. A spring acts on the clamping plate so that the locking arm is canted in the hole and binds on the edges of the hole, thereby locking the sole depressor against movement to a heel-releasing position. A handle can deliberately unlock the sole depressor by straightening the clamping plate against the action of the spring so that the locking arm is no longer canted and no longer binds on the edges of the hole.

9 Claims, 5 Drawing Figures

HEEL MOUNTING DEVICE FOR SKI BINDING

The invention relates to a heel mounting device for a ski binding in which a sole depressor is pivotable to a heel-engaging position and is biassed by a spring in that position, a handle being provided which, when actuated, permits the sole depressor to pivot to a heel-releasing position.

Such heel mounting devices are known in various forms and generally also comprise a pedal which is operatively connected to the sole depressor, is actuated by the heel of the ski boot when the latter is introduced in the binding and serves to lock the sole depressor in the heel-engaging position (see for example German Specification 2,135,808).

One type of these heel mounting devices can be opened only deliberately by actuating the handle, whilst another type for a so-called safety ski binding also opens automatically when a correspondingly large force acts on the sole depressor.

With one exception, both types of heel mounting devices possess two inherent disadvantages. Firstly, the sole depressor must be set to a particular thickness of the sole of the ski boot and secondly the sole depressor can no longer be locked in a heel-engaging position if there is even a thin layer of snow packed between the sole and the surface of the ski. This means that both the ski boot and the ski must have the snow cleaned off them before the boot can be engaged in the ski binding.

In one more recent type of heel mounting device for a safety ski binding, these disadvantages are avoided in that the sole depressor is elastically mounted and this elasticity is used to compensate for differences in the sole thickness and, to a certain extent, for any layer of snow packed between the boot and the ski. It will be evident that in practice this construction has serious limitations because the elasticity of the sole depressor mounting is now lost for its intended purpose and cannot be increased at will.

It is an object of the present invention to avoid the aforementioned disadvantages generally for all types of heel mounting devices or ski bindings.

According to the invention, a mounting device for the heel of a ski boot in a ski binding for a ski comprises a frame member securable to the ski, a sole depressor pivotable on the frame from an inoperative position to a sole-engaging operative position about a pivot shaft disposed behind the heel transversely to the length of the ski, a first spring biassing the sole depressor to its operative position, a locking arm disposed in the pivoting plane of the sole depressor and carried at one end portion by one of said sole depressor and frame member, a clamping lever disposed in the pivoting plane of the sole depressor and pivoted to the other of said sole depressor and frame member about a pivot pin parallel to said pivot shaft, said clamping lever containing a hole through which said locking arm passes with little play and said clamping lever being biassed by a second spring towards said one end portion of the locking arm so that the clamping lever normally assumes a clamping position in which the locking arm is canted in the hole, and a handle for deliberately freeing the sole depressor for movement to the inoperative position by acting on the clamping lever to pivot same against the action of said second spring to a releasing position in which the locking arm is not canted in the hole.

Irrespective of the sole thickness and any layer of snow between the boot and the ski, the sole depressor of the mounting device according to the invention will always come to lie on the upper edge of the sole, preferably after actuation of a pedal by the heel of the boot. Whereas swinging of the sole depressor to the inoperative or heel-releasing position is prevented by the canted engagement of the locking arm in the hole of the clamping lever, it can readily swing in the opposite direction if, for example, a layer of snow packed between the boot and the ski gradually decreases in thickness. This is because the canting of the locking arm is effective only in one direction.

The locking arm may be fixed to the said one of said sole depressor and frame member and its other end portion may be arcuate with the centre of curvature at the axis of said pivot shaft, said clamping lever being mounted on the pivot pin for radially limited displacement or the pivot pin itself being displaceable within limits. Alternatively, the locking arm may be pivoted to the said one of said sole depressor and frame member about an axis parallel to the pivot shaft. This particular form of the invention is somewhat simpler from a manufacturing point of view.

Preferably, the handle is adapted to be swung to engage an abutment on the sole depressor for pivoting same to the inoperative position, the handle acting on the clamping lever through a movable transmission member which is carried along by the handle to engage the clamping lever as the handle is swung towards said abutment. The transmission member may comprise one limb of a third spring which is stronger than said second spring, is coiled on said pivot shaft and has its other end bearing on the handle.

The forms of heel mounting device according to the invention described thus far are of the type where the boot is held tight to the ski surface from which it can only be deliberately released. The mounting devices can also be used to advantage on so-called releasing plates. However, since an absolute rigid retention of the heel is not favoured by most skiers because of the considerable strain placed on the ligaments and muscles leading to rapid tiring, the clamping lever may be pivoted to said other of said sole depressor and frame member by way of an intermediate lever biassed to a normal position by a fourth spring against the action of which the said sole depressor is able to execute limited motion towards said inoperative position. In this way a constant elasticity is achieved irrespective of the sole thickness and any intermediate layer of snow. In this construction, an abutment may be provided in the path of the clamping lever, thereby providing a heel mounting device with safety release. If the abutment is in the form of an adjustable screw, the releasing force can be readily set to meet particular requirements.

Examples of the invention will now be described with reference to the accompanying diagrammatic drawings, wherein.

Figure 1:
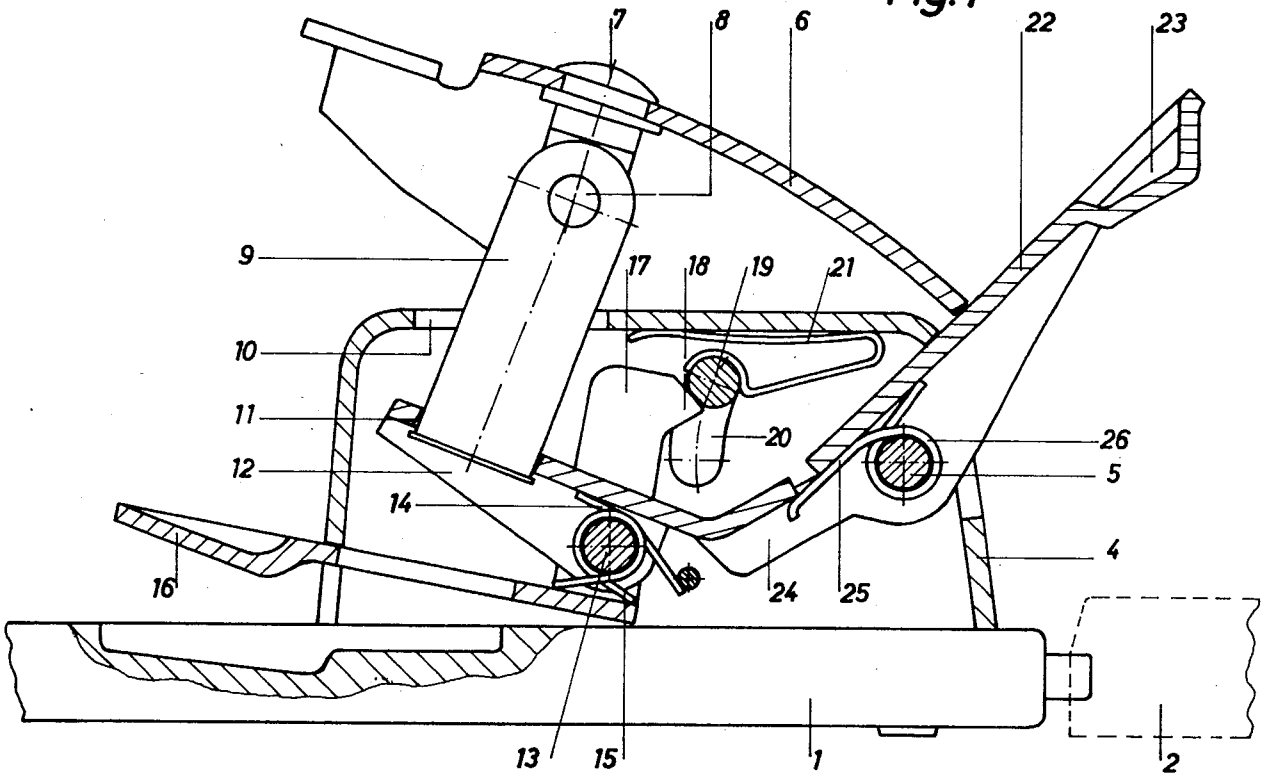
FIG. 1 is a central longitudinal section of a heel mounting device with a sole depressor in the inoperative position.
Figure 2:
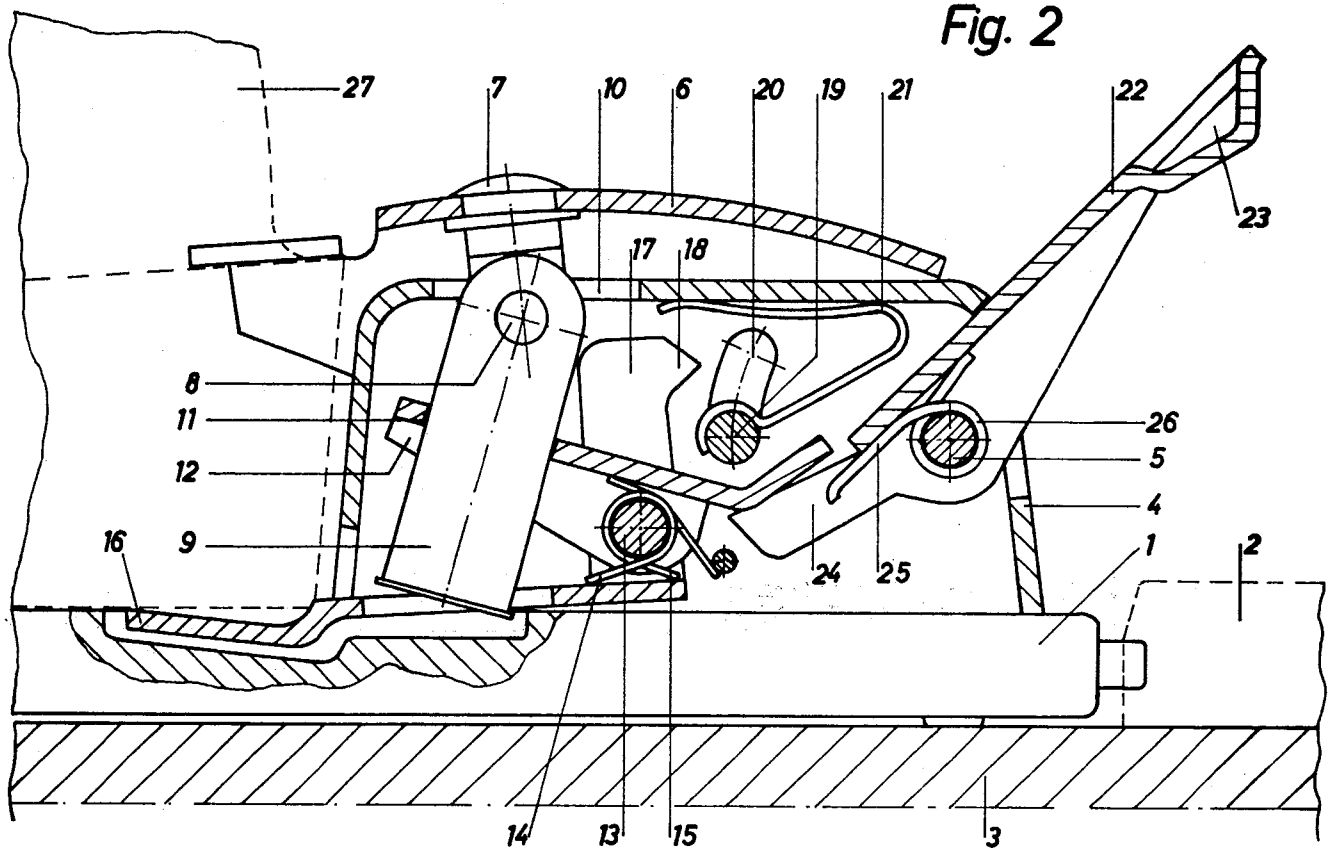
FIG. 2 is a view similar to FIG. 1 but with the sole depressor in the operative position.

The heel mounting device shown in FIGS. 1 and 2 is secured in any suitable manner to the rear end of a releasing plate 1 which, in turn, is mounted on a ski 3 and held in position by a device 2 which, on the occurrence of a predetermined overload, automatically releases the plate 1.

The heel mounting device comprises a fixed frame member 4 which is shown in the form of a housing. The longitudinal side walls of the housing support a horizontal shaft 5 on which a sole depressor 6 is pivotally mounted. The sole depressor is substantially U-shaped in cross-section and straddles the housing 4. The web of the U of the sole depressor has a retaining pin 7 riveted to it. The retaining pin carries a pivot pin 8 for a locking lever 9, the pivot pin 8 being parallel to the shaft 5. The locking lever 9 extends through a hole 10 in the upper wall of the housing 4 and engages with little play in the hole 11 of a clamping plate or lever 12. This clamping lever is pivotally mounted on a shaft 13 carried by the side walls of the housing 4 to be parallel to the shaft 5. The clamping lever is biassed upwardly by a spring 14 so that the locking lever 9 is normally canted in the hole 11 of the clamping lever 12.

The shaft 13 also supports a bell crank lever 16, 17 which is influenced by a spring 15 biassing it to the FIG. 1 position. The free end of the arm 16 of the bell crank lever is in the form of a pedal whereas the free end of the arm 17, which is at approximately right-angles to the arm 16, is in the form of a locking lug 18. This locking lug serves to hold the sole depressor 6 in the inoperative or heel-releasing position of FIG. 1. For this purpose the sole depressor is provided with a cross-member 19 bridging the limbs of the U section, the cross-member extending through a slot 20 in each side wall of the housing 4. The cross-member is under the influence of one limb of a hairpin spring 21, of which the other limb bears against the upper wall of the housing 4. This spring 21 biasses the sole depressor 6 to swing downwardly.

Within the housing 4, the shaft 5 carries a further bell crank lever 22, 24, of which the arm 22 serves as a handle for deliberately tilting the clamping lever 12 so that the locking lever 9 is no longer in a canted position in the hole 11. A depression 23 in the arm 22 can be engaged by the end of a ski stick. The second arm 24 of the bell crank lever extends to beneath the cross-member 19 (see particularly FIG. 2) and, when the arm 22 is operated, the arm 24 pushes the cross-member 19 and thus the sole depressor 6 to the heel-releasing position of FIG. 1. Before this, the clamping action between the locking lever 9 and clamping lever 12 caused by the canted position of the lever 9 in the hole 11 has to be undone by pivoting the clamping lever 12 so that the locking lever 9 can be freely pulled through the hole 11 as the sole depressor 6 rises. The clamping lever 12 is pivoted by one end 25 of a spring 26 wound around the shaft 5. The end 25 engages the clamping lever 12 before the arm 24 reaches the cross-member 19. The spring 26 is stronger than the spring 14 acting on the clamping lever 12 in the opposite direction.

To close the heel mounting device, i.e. to engage the sole depressor 6 with the upper edge of the heel portion of the sole of a ski boot 27, the toe portion of the latter is first of all engaged with a sole holder (not shown) which is mounted on the releasing plate 1 at the toe end of the boot. The heel of the boot is then pressed downwardly, whereby the sole strikes the pedal of the bell crank lever 16, 17, whereby the bell crank lever is swung against the action of the spring 15 so that the cross-member 19 is released by the locking lug 18. The sole depressor 6 is now free to swing downwardly under the action of the spring 21 until its end bears on the upper edge of the sole of the boot 27, the locking lever 9 having been projected through the clamping lever 12 to a corresponding further extent. Such projection of the locking lever 9 is readily permitted by the clamping lever 12 because in this direction the clamping lever 12 yields resiliently and there will be no binding action between the levers 9 and 12. It will be evident that with this construction of heel mounting device the thickness of the sole of the boot 27 or the combined thickness of the sole and any snow that is packed beneath the boot will be immaterial. The sole depressor 6 will in any case come to lie on the upper edge of the sole. Should there be a layer of snow between the sole and the releasing plate 1 and if this layer subsequently becomes thinner, then the sole depressor 6 will automatically be lowered further under the influence of the spring 21.

On the other hand, the boot 27 is securely held by the depressor 6 against any upward movement because the clamping action between the levers 9 and 12 prevents upward swinging of the depressor 6. Opening of the heel mounting device is effected in the aforementioned manner by pushing on the handle or lever arm 22.

Figure 3:
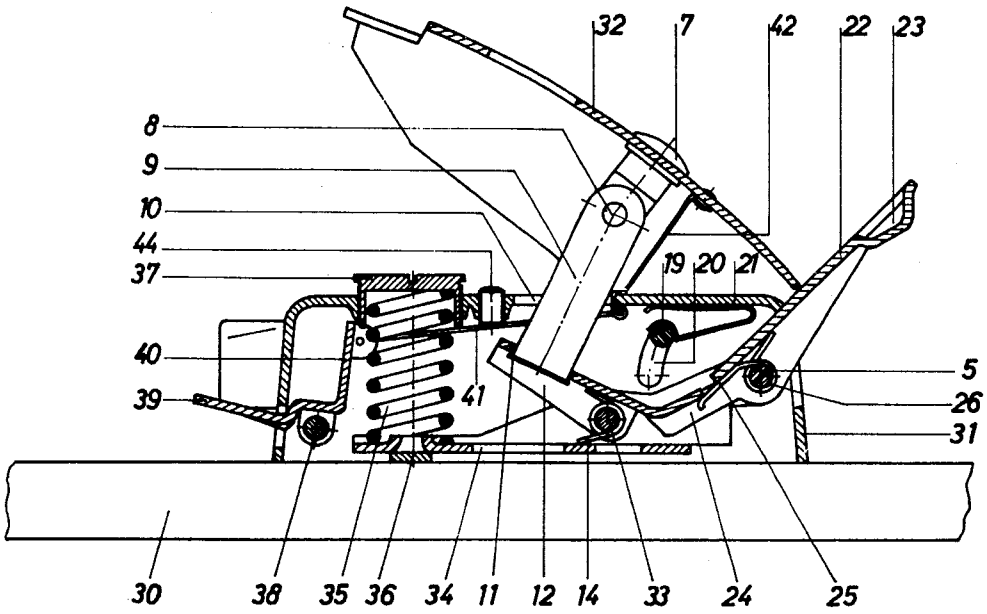
FIGS. 3 and 4 are correspondingly similar views of a second form of heel mounting device.
Figure 4:
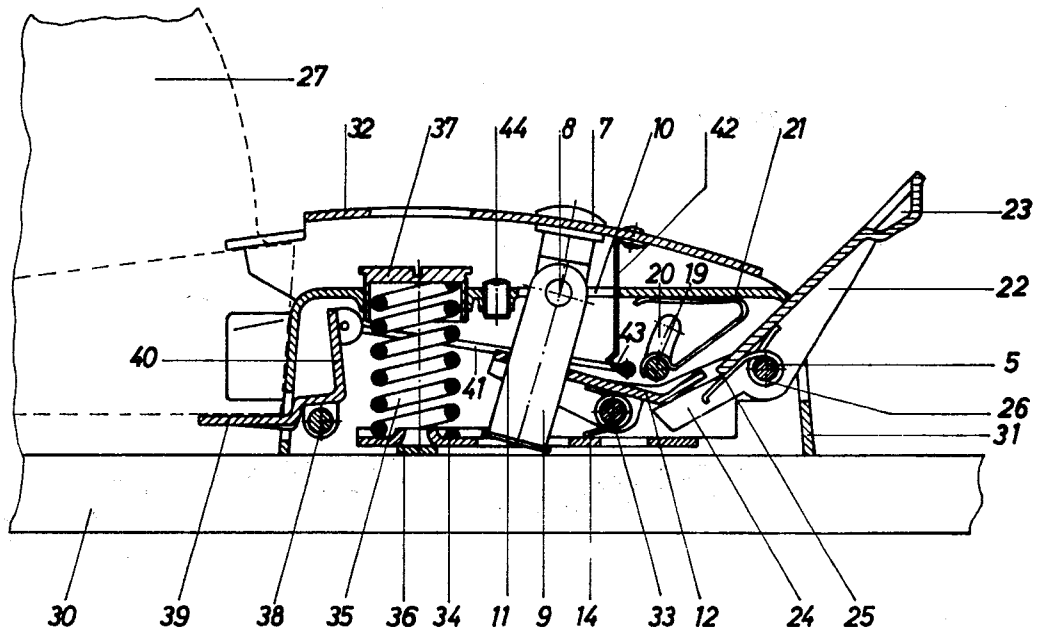

FIGS. 3 and 4 illustrate a different form of the invention in which provision is made for a safety release. In this case, the mounting device is fixed in any suitable manner to the top of a ski 30. A frame of the mounting device is again in the form of a housing 31 of which the longitudinal side walls carry a horizontal shaft 5. The sole depressor 32 is pivotally mounted on this shaft 5. As in the case of FIGS. 1 and 2, the sole depressor is substantially of U-shaped cross-section. The clamping arrangement is also much the same as in FIGS. 1 and 2. Thus, there is again a retaining pin 7 with pivot pin 8 for the locking lever 9, the clamping lever 12 with its hole 11 for the locking lever, the bell crank lever 22, 24 pivoted to the shaft 5 and the coiled spring 26. The limbs of the U-shaped depressor 32 again carry the cross-member 19 which is displaceable in slots 20 in the side walls of the housing 31, the cross-member again being under the influence of a hairpin spring 21.

In departure from the FIGS. 1 and 2 embodiment, the shaft 33 for the clamping lever 12, which is again under the influence of a spring 14, is not mounted directly in the side walls of the housing but in an intermediate lever 34. This intermediate lever is pivoted to the shaft 5 and influenced by a helical compression spring 35 which normally holds it against a fixed abutment 36. The compression spring 35 bears against a screw plug 37 of the housing 31 so that the force of the spring can be varied by turning the plug. An abutment screw 44 extends into the path of movement of the clamping lever 12 for the non-deliberate release of the clamping action exerted on the locking arm 9.

On a shaft 38 parallel to the shaft 5 and held in the side walls of the housing 31 there is a bell crank lever 39, 40 of which the arm 39 constitutes a pedal. The other arm 40, which is substantially at right-angles to the arm 39, is connected to the free end of a spring 42 by a link 41. This spring 42 is riveted to the web of the U-shaped sole depressor 32 and it is bent to form a catch groove 43 (see FIG. 4). This catch groove serves to engage the rear edge of the hole 10 in the upper wall of the housing 31 through which the locking lever 9 extends freely.

Introduction of the ski boot 27 in the binding takes place in the usual manner in that the ski boot is first of all engaged with front jaws (not shown) which are also mounted on the ski 30, and is then pressed downwardly. The heel thereby strikes the pedal 39 and causes the link 41 to pull the spring 42 out of engagement with the upper wall of the housing 31 so that the sole depressor 32 can be tilted downwardly under the influence of the spring 21 until its free end comes to lie on the upper edge of the sole. In the same way as in the first embodiment, the locking lever 9 is correspondingly projected further through the hole 11 of the clamping lever 12.

The sole depressor 32 cannot be swung upwardly at will because the locking lever 9 binds on the edges of the hole 11 of the clamping lever 12. Deliberate opening of the heel mounting device for the purpose of releasing the ski boot is effected by operating the handle or lever arm 22 such as by inserting a ski stick in the depression 23. As the bell crank lever 22, 24 is pivoted, the spring 26 is taken along with it so that the free end of the limb 25 of the spring will act on the clamping lever 12 to swing same about the shaft 33 against the action of the spring 14, whereby the clamping action on the locking lever 9 is released. On further pivoting of the lever arm 22, the arm 24 strikes the cross-member 19 of the sole depressor 32 and moves the cross-member and thus the depressor upwardly against the action of the spring 21. As soon as the sole depressor has reached its upper limiting position, the catch groove 43 of the spring 42 engages the edge of the hole 10 in the upper wall of the housing 31 so that the sole depressor cannot be swung back under the action of the spring 21.

Safety release of the heel mounting device takes place when an upwardly directed force acting on the ski boot 27 and transmitted thereby to the sole depressor 32 exceeds the force of the helical compression spring 35. However, this safety release does not occur with a snap-action but only after an elastic path has been traversed, this path being determined by the distance between the free end of the clamping lever 12 and the abutment screw 44. If the force on the boot is correspondingly high, the intermediate lever 34 is carried along through the locking lever 9 and clamping lever 12 against the action of the compression spring 35 until the free end of the clamping lever 12 strikes the abutment screw 44. This releases the clamping action on the locking lever 9 and the sole depressor 32 can now swing upwardly against the action of the relatively weak force of the spring 21 until the spring 42 engages the housing 31.

If the sole depressor does not reach the upward limit of its pivotal motion under the action of the ski boot that is being released, because both parts execute opposite movement, the lever arm 22 need merely be actuated once so that the heel mounting device is brought into a condition where the boot can be introduced again.

Figure 5:
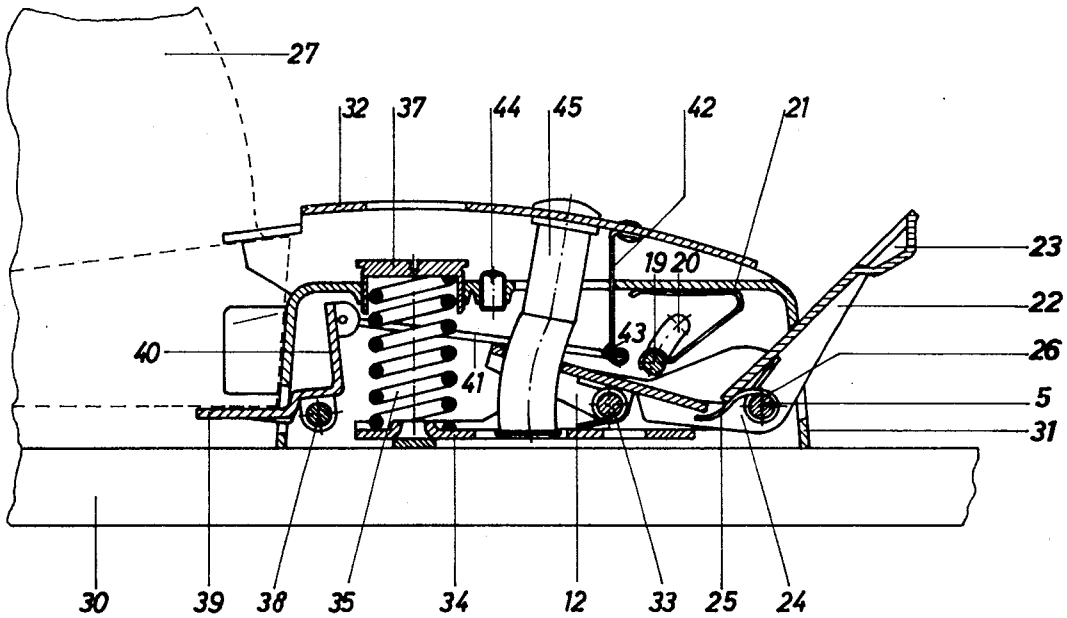
FIG. 5 is a view corresponding to FIG. 4 of a third form of heel mounting device.

The FIG. 5 embodiment of the invention is much the same as that in FIGS. 3 and 4 and consequently the equivalent parts have been identified by like reference numerals. In contrast, however, the locking lever in FIG. 5 is in the form of an arm 45 that is rigidly connected to the sole depressor 32 by one end. The other end portion of the arm 45, i.e. the portion on which clamping action will be exerted by the clamping lever 12, is curved with the centre of curvature at the axis of the pivot shaft 5 for the sole depressor 32. Another departure is that the clamping lever 12 is displaceable on the shaft 33 to a small radial extent so that downward pivoting of the sole depressor will not be prevented by any clamping of the arm 45 in the hole of the clamping lever 12. Alternatively, the shaft 33 may itself be displaceable to a limited extent to achieve the same purpose.

In the illustrated embodiments the locking lever or arm is shown as being carried by the sole depressor and the clamping lever as being carried directly by the frame or indirectly through the intermediate lever. It will be evident that there can be a mechanical reversal in so far that the locking lever or arm is carried by the frame and the clamping lever by the sole depressor, the function remaining unchanged.

I claim:

1. A mounting device for the heel of a ski boot in a ski binding for a ski, comprising a frame member securable to the ski, a sole depressor pivotable on the frame from an inoperative position to a sole-engaging operative position about a pivot shaft disposed behind the heel transversely to the length of the ski, a first spring biassing the sole depressor to its operative position, a locking arm disposed in the pivoting plane of the sole depressor and carried at one end portion by said sole depressor, a clamping lever disposed in the pivoting plane of the sole depressor and pivoted to said frame member about a pivot pin parallel to said pivot shaft, said clamping lever containing a hole through which said locking arm passes with little play and said clamping lever being biassed by a second spring towards said one end portion of the locking arm so that the clamping lever normally assumes a clamping position in which the locking arm is canted in the hole, and a handle for deliberately freeing the sole depressor for movement to the inoperative position by acting on the clamping lever to pivot same against the action of said second spring to a releasing position in which the locking arm is not canted in the hole.

2. A mounting device according to claim 1, wherein the locking arm is fixed to said sole depressor and its other end portion is arcuate with the centre of curvature at the axis of said pivot shaft, said clamping lever being mounted on the pivot pin for radially limited displacement or the pivot pin itself being displaceable within limits.

3. A mounting device according to claim 1, wherein said locking arm is pivoted to said sole depressor about an axis parallel to said pivot shaft.

4. A mounting device according to claim 1, wherein said handle is adapted to be swung to engage an abutment of said sole depressor for pivoting same to said inoperative position and wherein said handle acts on said clamping lever through a movable transmission member which is carried along by the handle to engage the clamping lever as the handle is swung towards said abutment.

5. A mounting device according to claim 4, wherein said transmission member comprises one limb of a third spring which is stronger than said second spring, is coiled on said pivot shaft and has its other end bearing on the handle.

6. A mounting device according to claim 1, wherein said clamping lever is pivoted to said frame member by way of an intermediate lever biassed to a normal position by a fourth spring against the action of which the said sole depressor is able to execute limited motion towards said inoperative position.

7. A mounting device according to claim 6, including an abutment disposed in the path of the clamping lever.

8. A mounting device according to claim 7, wherein the abutment for the clamping lever is in the form of an adjustable screw.

9. A mounting device for the heel of a ski boot in a binding for a ski, comprising a frame member securable to the ski, a sole depressor pivotable on the frame from an inoperative position to a sole-engaging operative position about a pivot shaft disposed behind the heel transversely to the length of the ski, a first spring biassing the sole depressor to its operative position, a locking arm disposed in the pivoting plane of the sole depressor and carried at one end portion by said frame member, a clamping lever disposed in the pivoting plane of the sole depressor and pivoted to said sole depressor about a pivot pin parallel to said pivot shaft, said clamping lever containing a hole through which said locking arm passes with little play and said locking arm being biassed by a second spring towards said clamping lever so that the clamping lever normally assumes a clamping position in which the locking arm is canted in the hole, and a handle for deliberately freeing the sole depressor for movement to the inoperative position by acting on the locking arm to pivot same against the action of said second spring to a releasing position in which the locking arm is not canted in the hole.

* * * * *